US005239832A

United States Patent [19]

Koshoffer et al.

[11] Patent Number: 5,239,832

[45] Date of Patent: Aug. 31, 1993

[54] BIRDSTRIKE RESISTANT SWIRLER SUPPORT FOR COMBUSTION CHAMBER DOME

[75] Inventors: John M. Koshoffer, Cincinnati; James N. Cooper, Hamilton; Mary C. Haas, Middletown; James N. Reinhold, Jr., Cincinnati, all of Ohio

[73] Assignee: General Electric Company, Cincinnati, Ohio

[21] Appl. No.: 813,613

[22] Filed: Dec. 26, 1991

[51] Int. Cl.[5] ..... F02C 3/14; F23R 3/60

[52] U.S. Cl. ..... 60/740; 60/756; 60/39.31

[58] Field of Search ..... 60/39.091, 39.092, 39.32, 60/737, 740, 748, 756, 752

[56] References Cited

U.S. PATENT DOCUMENTS

| | | | |
|---|---|---|---|
| 2,548,904 | 4/1951 | Neal et al. | 60/740 |
| 3,398,529 | 8/1968 | Schmitz et al. | 60/39.31 |
| 3,422,620 | 1/1969 | Fantozzi et al. . | |
| 3,978,662 | 9/1976 | DuBell et al. . | |
| 4,077,205 | 3/1978 | Pane et al. . | |
| 4,180,974 | 1/1980 | Stenger et al. | 60/748 |
| 4,373,342 | 2/1983 | Willis et al. | 60/748 |
| 4,653,278 | 3/1987 | Vinson et al. | 60/737 |
| 4,763,482 | 8/1988 | Wehner | 60/748 |
| 4,773,227 | 9/1988 | Chabis . | |
| 5,117,637 | 6/1992 | Howell et al. | 60/748 |

FOREIGN PATENT DOCUMENTS

| | | | |
|---|---|---|---|
| 0078630 | 5/1983 | European Pat. Off. . | |
| 0079216 | 5/1983 | European Pat. Off. . | |
| 0242319 | 10/1987 | European Pat. Off. . | |
| 0244342 | 11/1987 | European Pat. Off. . | |
| 954116 | 11/1956 | Fed. Rep. of Germany | 60/748 |
| 642257 | 6/1948 | United Kingdom . | |
| 713422 | 8/1954 | United Kingdom | 60/748 |
| 789741 | 11/1955 | United Kingdom . | |
| 1099374 | 1/1968 | United Kingdom . | |
| 2102558 | 2/1983 | United Kingdom . | |
| 2135440 | 8/1984 | United Kingdom . | |

*Primary Examiner*—Richard A. Bertsch
*Assistant Examiner*—Timothy S. Thorpe
*Attorney, Agent, or Firm*—Jerome C. Squillaro; James P. Davidson

[57] ABSTRACT

A backing support or bumper mounted downstream of the disk shaped flange of the venturi in adjacently lying fuel cup assemblies and extends to a mid portion of each flange to prevent rotation of the flange and possible disengagement of the fuel nozzle in the event of a bird strike or impact by a foreign object on the dome of the combustor or on the flange itself. The invention provides for a single or double supporting bumper faces or a pair of supporting surfaces on the bumper.

14 Claims, 6 Drawing Sheets

BIRDSTRIKE RESISTANT SWIRLER SUPPORT FOR COMBUSTION CHAMBER DOME

FIELD OF THE INVENTION

The present invention relates generally to gas turbine engine combustors and, more particularly, to a birdstrike resistant swirler support for the combustion chamber dome.

BACKGROUND OF THE INVENTION

Combustors used in gas turbine engines, such as aircraft engines, conventionally include sheet metal combustion liners and sheet metal combustion dome assemblies. The combustion liners include coannular outer and inner combustion liners joined at their upstream ends by an annular dome for defining therein an annular combustion dome. The dome includes a plurality of circumferentially spaced carburetors for providing a fuel/air mixture into the combustor which is conventionally ignited for generating combustion gases. The combustor is supplied with compressed airflow from the compressor upstream thereof which subjects the dome to a pressure loading by the high velocity compressed airflow. In addition, the combustor structure is vibrationally active and subject to thermal expansion of the components during engine operation resulting in relative movement between the various components.

It is well known that during ground operation or during take-off at some airports, the engines exert a powerful suction effect in front of them, resulting in some instances in the ingestion of birds or other objects.

The combustor domes in present operation, when subjected to a birdstrike to the engine core, have occasionally shown disengagement of the fuel nozzle and of the swirler. The movement of the swirler, relative to the fuel nozzle, is due to the large bellmouth of the secondary swirler which supports the primary swirler but acts as a moment arm during impact. Such moment arm produces a moment about the center of the swirler, causing the swirler to rotate. The dome spectacle plate is then distorted allowing disengagement of the fuel nozzle.

OBJECTS AND SUMMARY OF THE INVENTION

It is, therefore, an object of the present invention to provide a new and improved combustor structure for a gas turbine engine capable of providing reliable protection against the effects of birds or other objects striking the core engine.

It is another object of the present invention to provide means for the combustor dome for a gas turbine engine of an aircraft which is simple in its structure yet capable of providing a reliable protection against the effects of birds or other objects striking the core engine.

It is still another object of the present invention to provide a means for the combustor dome for a gas turbine engine of an aircraft which is simple in its structure and can be added to a state of the art engine without substantial structural modification and yet capable of providing a reliable protection against the effects of birds or other objects striking the core engine.

It is still a further object of the present invention to provide a means for the combustor dome of a gas turbine engine of an aircraft whether the dome is of the can, annular or double dome type, which is simple in its structure and can be added to a state of the art engine of the above types without substantial structural modification and yet capable of providing a reliable protection against the effects of birds or other objects striking the core engine.

It is still another object of the present invention to provide a means for the combustor dome of a gas turbine engine of an aircraft whether the dome is of the can, annular or double dome type, which is simple in its structure and yet capable of preventing disengagement of the fuel nozzle and of the swirler upon birds or other objects striking the core engine.

It is yet still another object of the present invention to provide a means for the combustor dome of a gas turbine engine of an aircraft whether the dome is of the can, annular or double dome type, which is simple in its structure and can be added to a state of the art engine of the above types without substantial structural modification and yet capable of preventing disengagement of the fuel nozzle and of the swirler upon birds or other objects striking the core engine.

Accordingly, the present invention in the gas turbine engine of an aircraft provides bumper means downstream of the disk shaped flange of the venturi means of an adjacent pair of fuel cup assemblies for providing a backing effect against the swirler and the venturi flange rotating out of their mounting plane upon birds or other objects striking the core engine, thereby preventing disengagement of the fuel nozzle.

The present invention in another aspect thereof provides in the gas turbine engine of an aircraft a bumper means including a wide contact face and mounted downstream of the disk shaped flange of the venturi means of an adjacent pair of fuel cup assemblies for providing a backing effect against the swirler and the venturi flange rotating out of their mounting plane upon birds or other objects striking the core engine, thereby preventing disengagement of the fuel nozzle.

The present invention in still another aspect thereof provides in the gas turbine engine of an aircraft a bumper means including a wide contact face and mounted on existing coupling means of the dome to the liner and the cowl and extending downstream of the disk shaped flange of the venturi means of an adjacent pair of fuel cup assemblies for providing a backing effect against the swirler and the venturi flange rotating out of their mounting plane upon birds or other objects striking the core engine, thereby preventing disengagement of the fuel nozzle.

The present invention more particularly provides a bumper structure for improving the impact resistance of a combustor in a gas turbine engine. The combustor includes a dome plate supported between inner and outer combustor liners. Fuel nozzles are mounted in fuel cup assemblies supported from the dome plate. The bumper extends from a liner and is closely spaced with respect to a fuel cup assembly. Loads caused by foreign object debris impacting the fuel cup assembly are transmitted through the bumper into the liner, rather than into the dome. Distortion of the dome is reduced, thereby preventing rotation of the fuel cup assembly and disengagement of the fuel nozzle from the fuel cup assembly.

BRIEF DESCRIPTION OF THE DRAWINGS

The present invention will become more readily apparent from the following description of preferred embodiments thereof, shown and illustrated by way of example, and described in reference to the accompanying drawings, in which.

DESCRIPTION OF THE PREFERRED EMBODIMENTS

Figure 1:
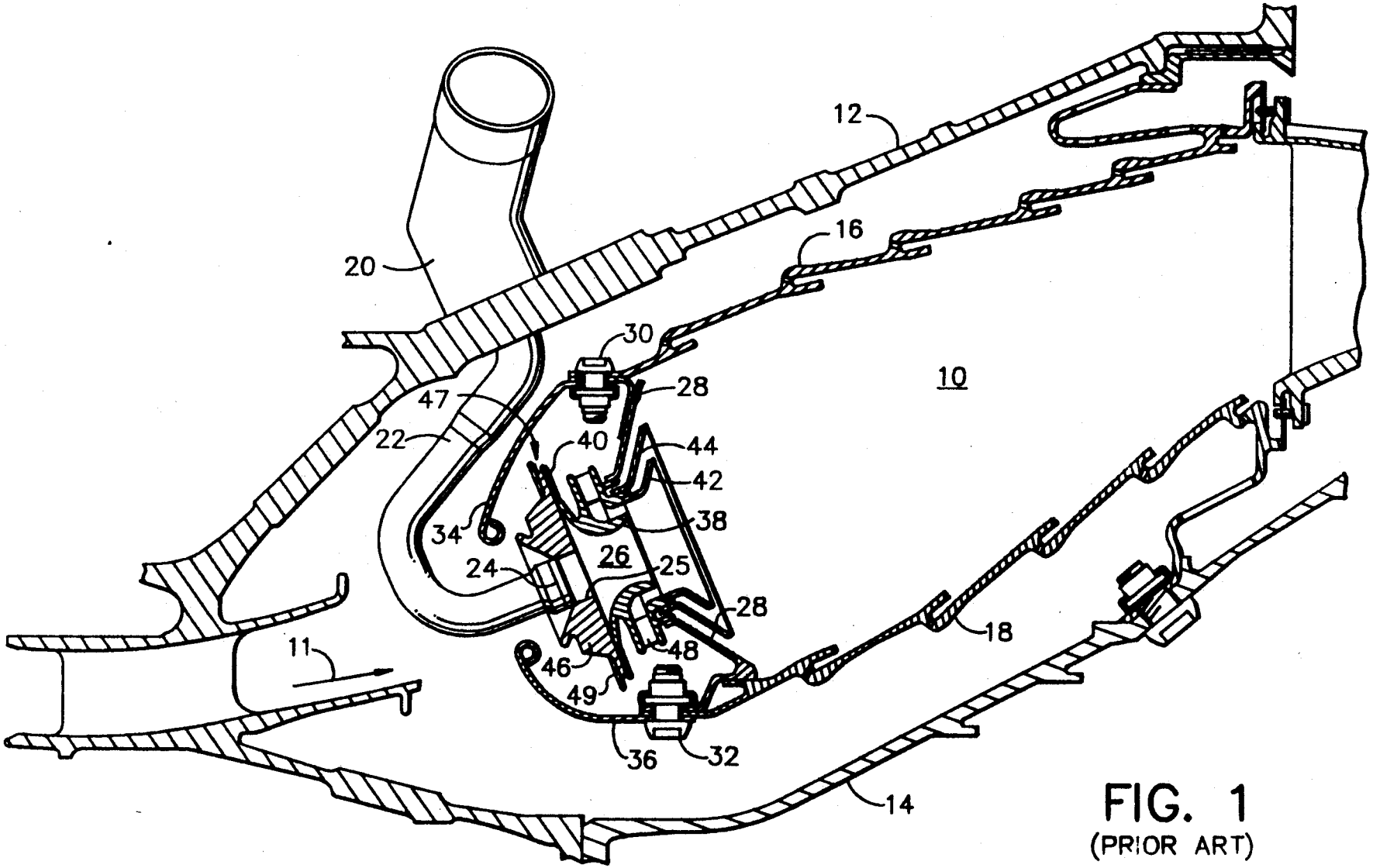
FIG. 1 (PRIOR ART)
FIG. 1 illustrates schematically and partly in section the region of interest of the combustor of a gas turbine engine of the state of the art to which the present invention is applicable.

With reference to the drawings, particularly to FIG. 1, representing a state of the art annular type combustor 10 of an aircraft engine, bounded by outer walls 12 and 14 within which the annular combustion chamber itself is defined by an outer liner 16, an inner liner 18, a front dome 28 and an outer cowl 34 and inner cowl 36. The cowls 34, 36 are fixedly coupled to the dome 28 and the liners 16, 18, such as, by bolts 30, 32. The fuel is supplied through a fuel nozzle valve 20 into a fuel nozzle stem 22 to the fuel nozzle 24 which is removably inserted into the fuel cup assembly 26. The compressed air arrives from the compressor (not shown) as indicated by the arrow 11 and, it streams under pressure toward the combustor 10. The fuel cup assembly conventionally includes a primary swirler 46, a primary swirler flange 47, a venturi 38 having a disc shaped mounting flange 40. A retaining ring 49 is welded to flange 40 and holds flange 47 in sliding contact with flange 40. Retaining ring 49 hides flange 47 in FIGS. 2 and 3. The assembly further includes a secondary swirler 48, a sleeve 42, and a splash plate 44. The functions and mutual cooperation of the above-mentioned elements of the combustor and of the fuel cup assembly 26 are well known in the art and have been the subject of a large number of publications, therefore, in order to avoid disclosure of extraneous material, which, however, may be important to understand the operation of the present invention, reference is made to U.S. Pat. No. 4,180,974 issued Jan. 1, 1980 to Richard E. Stenger, Edward E. Ekstedt and Stanford P. Seto and assigned to the assignee of the present invention. The teaching of this patent is specifically intended to be incorporated herein by reference for enabling one skilled in the art to understand the present invention without the disclosure of common and extraneous material.

Experience has shown that a bird entering the engine does not exit the compressor spread over a 360° arc. Instead, the bird debris travels in a relatively straight line through the compressor and strikes the combustor in an area that is two or three fuel cups wide. This bird debris can strike the inner cowl 36, and cause the inner cowl to deform and hit the primary swirler 46, or the bird debris can pass between the cowls and strike the large diameter "bellmouth" surface formed by retaining ring 49 and primary swirler flange 47. Loads on the large diameter bellmouth can create large bending moments in the dome 28. The forces and moments transmitted to the dome 28 can cause the supporting dome 28 to buckle. This distortion of the dome 28 can result in rotation of the fuel cup assembly 26 and disengagement of the fuel nozzle 24 from aperture 25 provided in the primary swirler 46. The rotation of the bellmouth and the buckling of the dome 28 may occur about any number of axes, not just about the radial axis.

Figure 2:
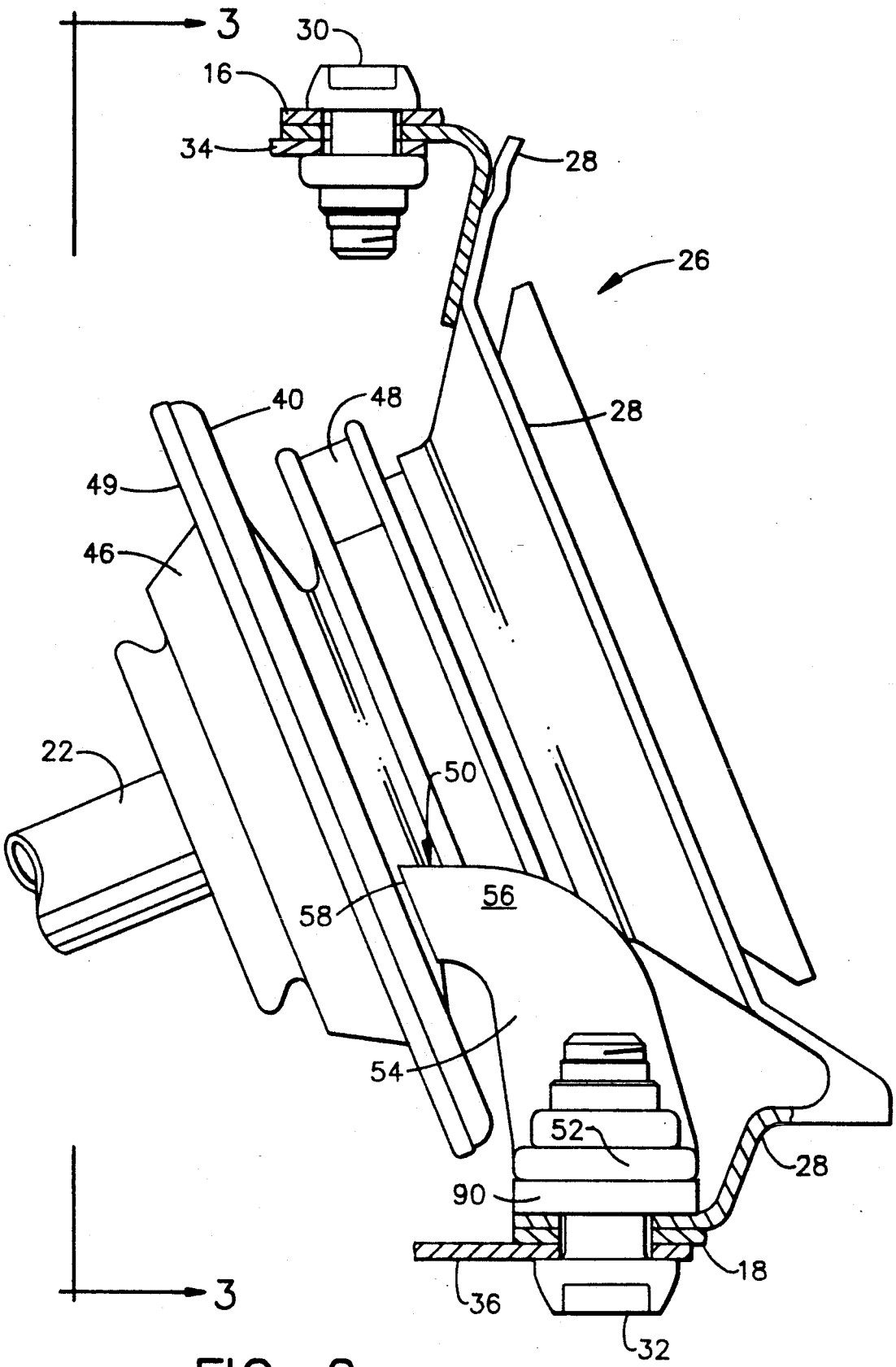
FIG. 2 illustrates schematically and partly in section the fuel cup assembly of a gas turbine engine incorporating features of the present invention.
Figure 3:
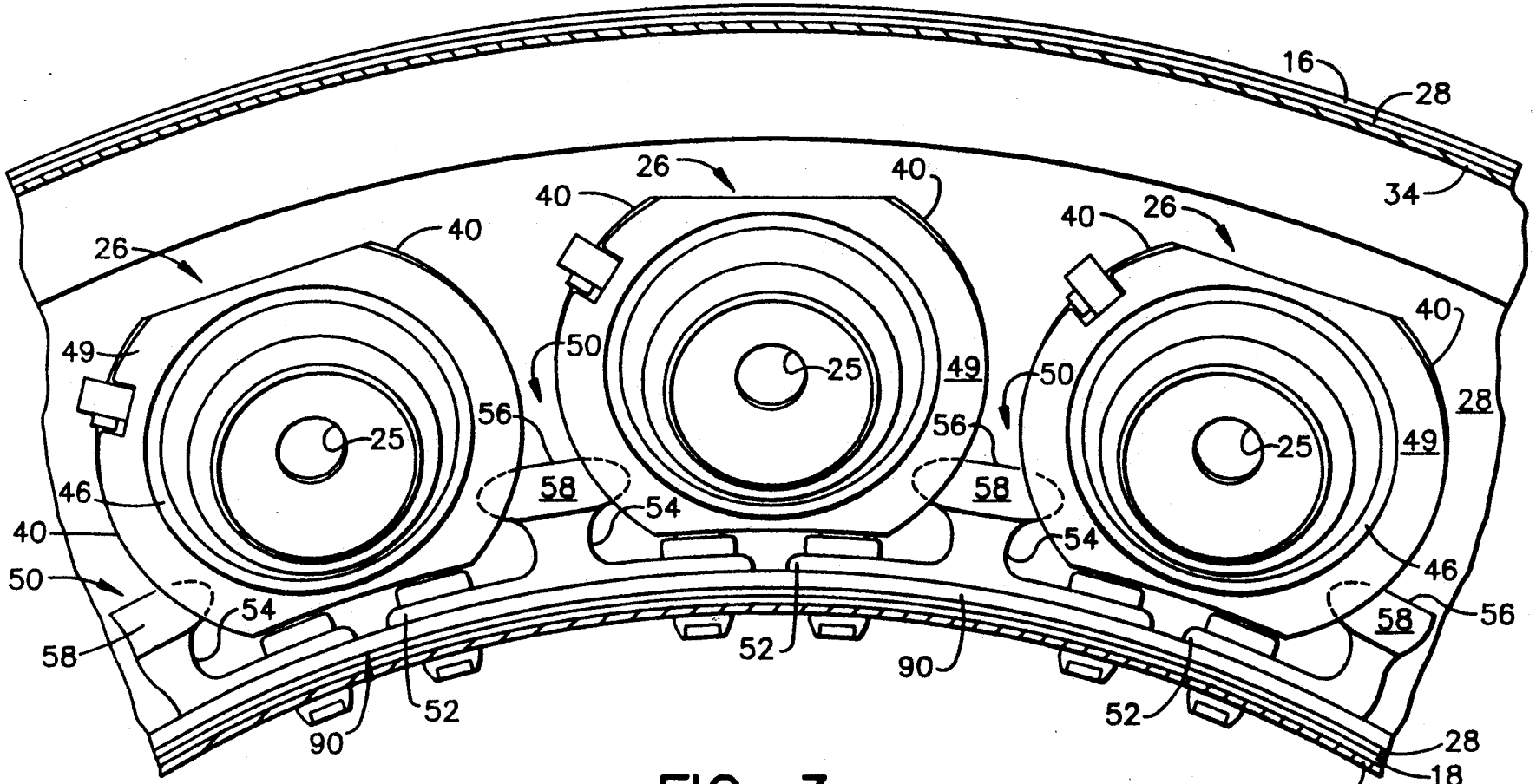
FIG. 3 illustrates schematically and partly in section three adjacent fuel cup assemblies when viewed in the direction of arrow 3—3 in FIG. 2, showing the mounting of a first embodiment of the bumper means according to the present invention.

With reference to FIGS. 2 and 3 incorporating features of one embodiment of the present invention, it is seen that a backing support or bumper means 50 comprising a mounting flange 52, an upstanding body portion including a neck portion 54, and a upwardly widening head portion 56 terminating in a flat contact surface 58, is mounted downstream of the disk shaped flanges 40 of the venturies 38 of a pair of adjacently lying fuel cup assemblies 26. The contact face 58 is parallel with the disk shaped flanges 40 and has a small clearance with them to allow for thermal expansion during operation and, thereby avoiding any interference with them during normal operation. It is also seen that for mounting the bumper means 50 the otherwise available lower coupling bolts 32 are used according to the present invention. According to one aspect of the present invention, a stiffening ring 90 has been added under the bumper 50 to prevent the loads transmitted into the bumper from distorting the sheet metal to which the bumper is attached. The ring can be 360° continuous or composed of arcuate segments. The bumper means 50 could also be mounted on the upper bolts 30, in which case it would be extending downward. The bumper device 50 according to the present invention can be made from a light but stiff, bending and heat resistant sheet metal or by casting from a heat resistant high strength superalloy, such as known by the experts in the art under the name Inconel 718. It is a feature of the present invention that the bumper means 50 can an add-on element to an existing aircraft engine. As noted above, the movement of the primary swirler 46 relative to the fuel nozzle 24 is due to the large bellmouth structure of the secondary swirler 48, which supports the primary swirler 46, and which acts as a moment arm during impact. The moment arm produces a moment about the center of the secondary swirler 48, causing rotation thereof which would allow the disengagement of the fuel nozzle 24 unless the load transferring capability of the inventive bumper means 50 would not counteract it. It is noted that the fuel cup assembly 26 is brazed to the dome 28 downstream of the secondary swirler 48. It is desirable to have a relatively flexible connection between the fuel cup assembly 26 and the dome 28 and the liners 16, 18 to accommodate the large relative thermal growth of the combustor components. Therefore, there is preferably a small gap at assembly between the bumper face 58 and the bellmouth or disk shaped flange 40 on the venturi 38 so that no load is transferred by the bumper means 50 unless the fuel cup assembly 26 is displaced by a foreign object impact as mentioned above. An impact of a foreign object on the upstream surface of flange 40 tends to distort the fuel cup assemblies in the dome 28 about a generally radially extending axis which would point from the centers of the fuel cup assemblies 26 shown in FIG. 3 toward the six and twelve o'clock direction and toward the outer edges of the disks 40. Therefore, the contact surface 58 of the bumper means 50, according to the present invention, is located to react against the outer circumference of the respective fuel cup assemblies 26 at a point approximately midway between the radially inner and outer ends of each fuel cup assembly 26.

Figure 4:
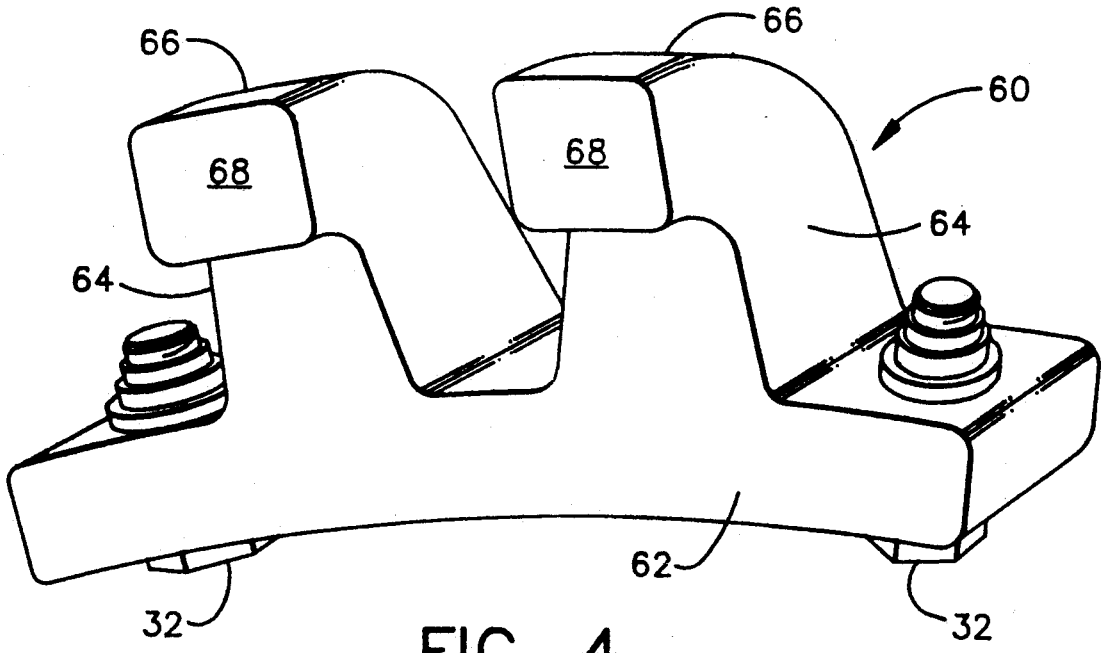
FIG. 4 illustrates in an isometric view a second embodiment of the bumper means according to the present invention.

With reference to FIG. 4 illustrating a second embodiment of the bumper means 60 according to the present invention, it is seen that it has a mounting flange 62 utilizing the coupling thereof to the existing lower bolts 32 and, similarly, as the first embodiment, each has an upwardly extending body portion including neck portions 64, head portions 66 and contact surfaces 68. When mounted, each bumper means 60 with its contact surface 68 is located downstream of its associated flange 40 in FIG. 3 to react against the outer extremities of the fuel cup assemblies 26 at a point approximately midway between the radially inner and outer ends of each adjacent fuel cup assembly 26.

Figure 5:
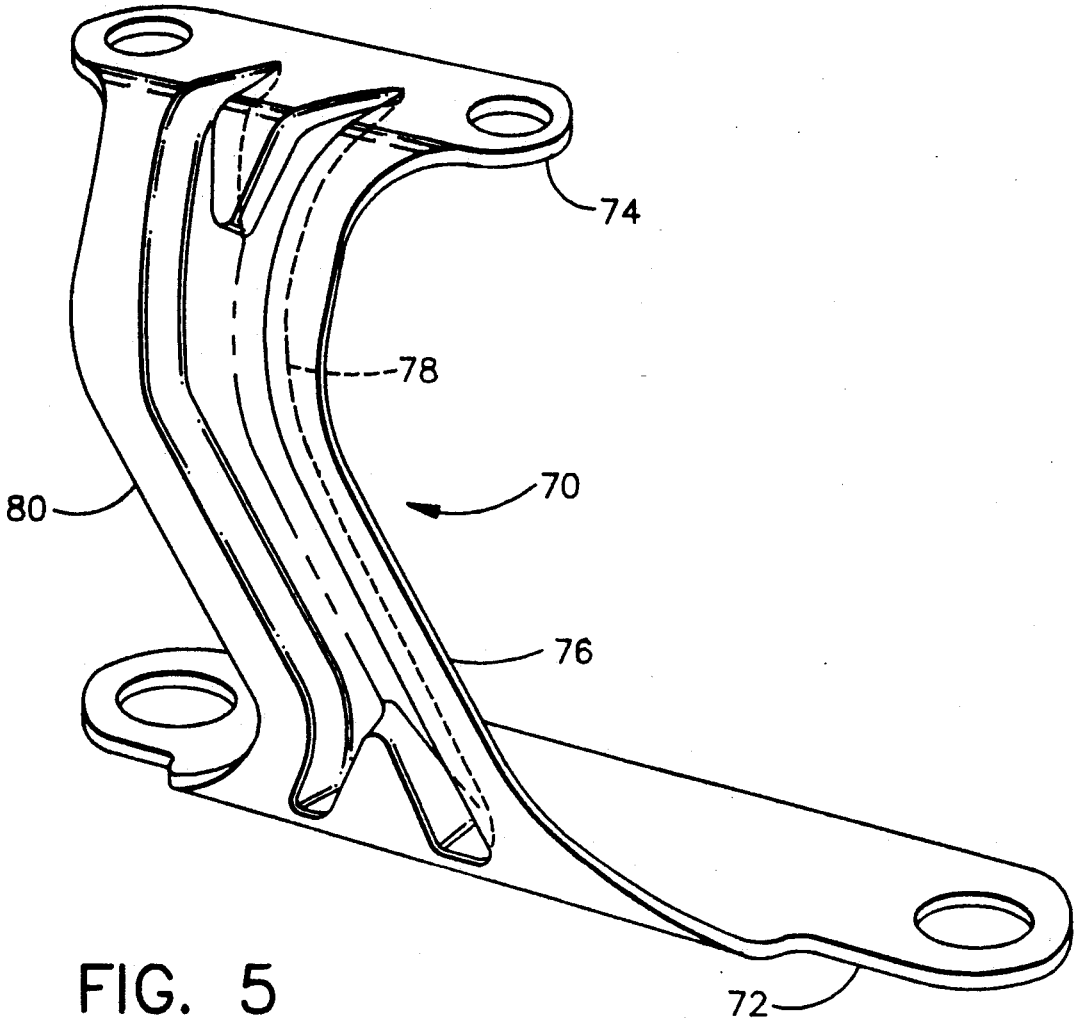
FIG. 5 illustrates in an isometric view a third embodiment of the bumper means according to the present invention.
Figure 6:
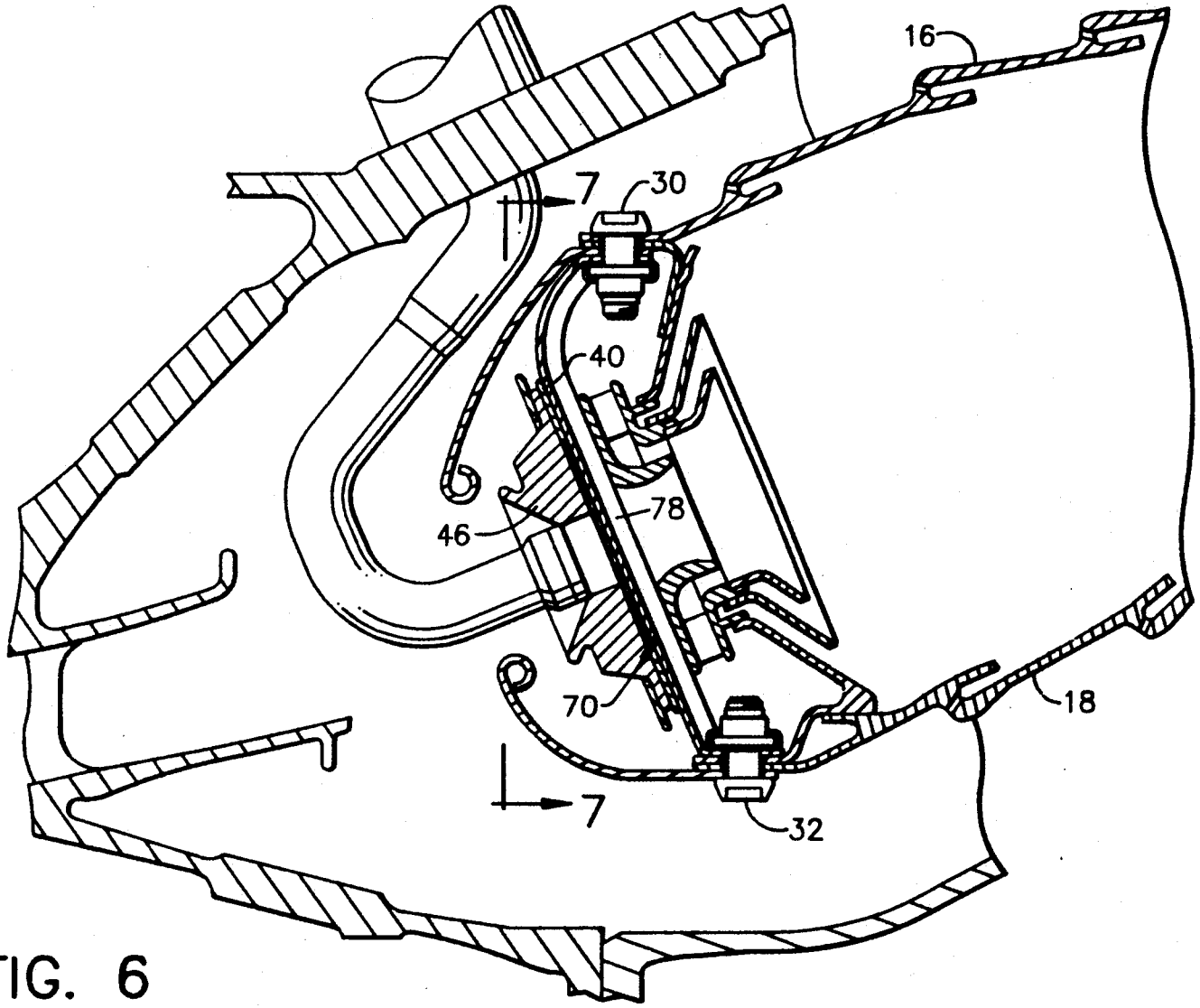
FIG. 6 illustrates schematically and partly in section the region of interest of the combustor of an aircraft engine with the fuel cup assembly showing the mounting of the bumper means according to a third embodiment of the present invention.
Figure 7:
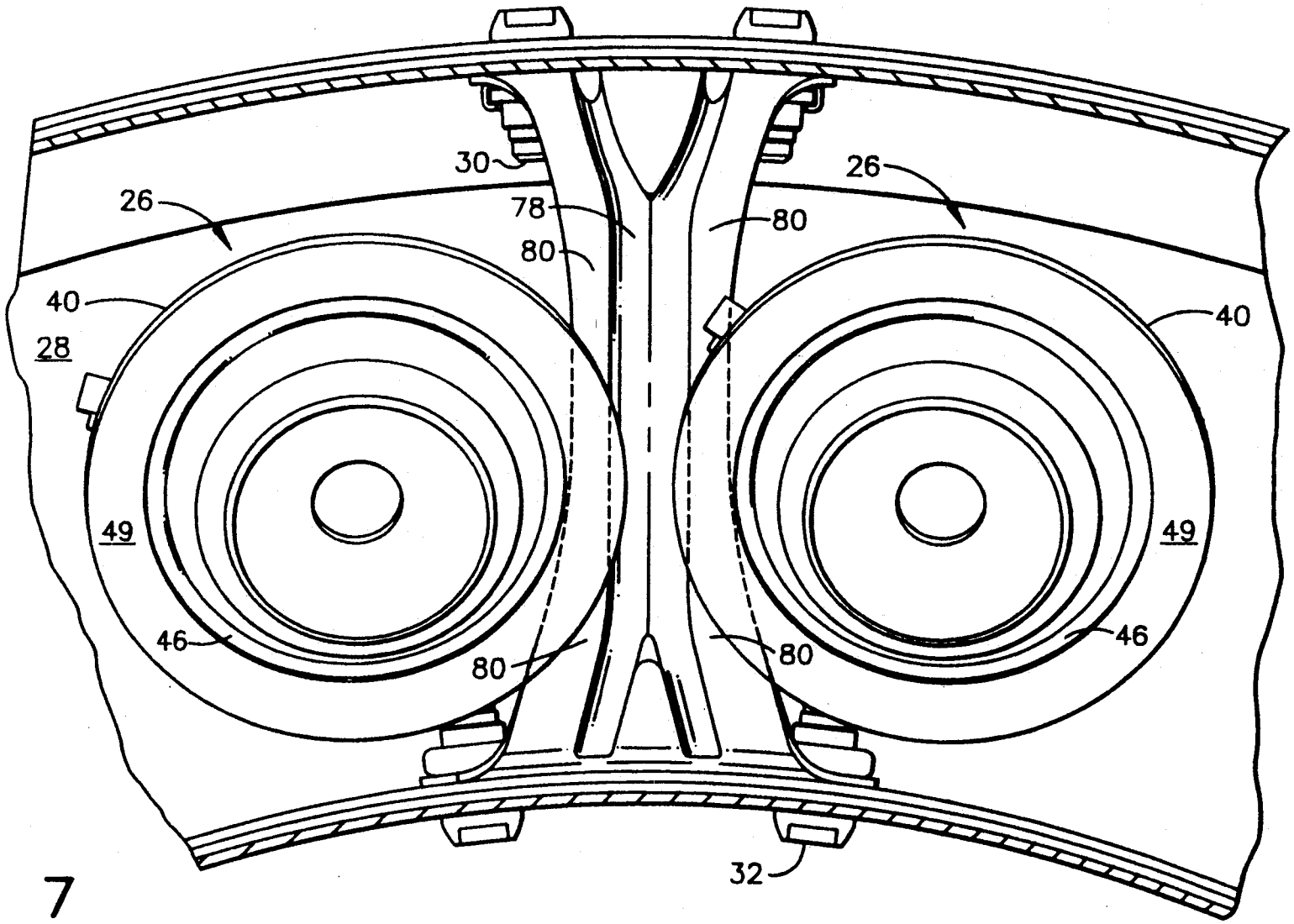
FIG. 7 illustrates schematically and partly in section a pair of adjacent fuel cup assemblies, when viewed in the direction of arrow 7—7 in FIG. 6, showing the mounting of the third embodiment of the bumper means according to the present invention.

With reference to FIG. 5 illustrating a third embodiment of the bumper means 70 according to the present invention, it is seen that it has a pair of mounting flanges 72 and 74 which are formed such that they are able to mate with the coupling bolts 30 and 32 already existing in the combustor assembly as shown in FIGS. 6 and 7. The bumper 70 has an elongated arcuate body 76 extending between the mounting flanges 72 and 74 with a centrally located stiffening rib or flange 78 and wing-like supporting surfaces 80 each to extend when mounted downstream of the associated flange 40 shown in FIG. 6 and, act as a contact or backing surface for the flange in case of an impact, similarly as described in connection with the other bumper embodiments 50 and 60.

As has been shown, and follows clearly from the above description of the present invention, the bumper structure in accordance with the present invention provides a reliable and secure support for the fuel cup assemblies during impact of a foreign object. Loads caused by debris impacting the fuel cup assembly 26 are carried by the bumper structures 50, 60 or 70 into the inner and outer liner sructures rather than into the domes. Therefore, less of the impact load is transmitted to the dome 28, therefore, dome buckling is eliminated. Rotation of the fuel cup assembly 26 and disengagement of the fuel nozzle 24 is also eliminated, because the dome 28 supports the fuel cup assembly 26.

It is within the scope of the present invention to form the bumpers as an integral extension from the combustor structure, such as a sheet metal support extending from one of the combustor liners or the combustor domes.

While there have been described herein what is considered to be preferred embodiments of the present invention, other modifications of the invention shall be apparent to those skilled in the art from the teaching herein and, it is, therefore, desired to be secured in the appended claims all such modifications as fall within the true spirit and scope of the invention.

Accordingly, what is desired to be secured by letters patent of the United States is the invention as defined and differentiated in the appended claims.

what is claimed is:

1. An annular combustor for a gas turbine engine including a compressor for supplying compressed air to said combustor, comprising:

(a) an outer liner;

(b) an inner liner spaced radially from said outer liner;

(c) a dome structure connecting said outer and inner liners so as to define a combustion chamber said dome structure having a plurality of openings therein;

(d) a plurality of fuel cup assemblies mounted to said dome structure so as to align substantially radially to said openings, said fuel cup assemblies being mounted to said dome structure in a mounting plane substantially perpendicular to said openings;

(e) a fuel nozzle for delivering fuel to each of said fuel cup assemblies, said fuel to be mixed with the compressed air into a combustible mixture;

(f) means for supporting each of said fuel nozzles in said fuel cup assemblies; and (g) means for providing backing support for said fuel nozzle supporting means against rotational movement out of said mounting plane in the event of an impact by a foreign object onto said fuel nozzle supporting means, said backing support means being located downstream of said fuel nozzle supporting means.

2. The combustor as claimed in claim 1, wherein said fuel nozzle supporting means includes a flange, wherein said backing support means is located downstream of said fuel nozzle support flange.

3. The combustor as claimed in claim 2, wherein said backing support means is located between adjacent pairs of said fuel cup assemblies downstream of said fuel nozzle support flange.

4. The combustor as claimed in claim 3, further comprising means for mounting each of said fuel cup assemblies on said dome structure, said backing support means including a mounting flange fixed to said fuel cup assembly mounting means.

5. The combustor as claimed in claim 4, wherein a stiffening means is arranged between said fuel cup assembly mounting means and said backing support mounting flange for preventing loads transmitted to said backing support means from distorting said fuel cup assembly mounting means.

6. The combustor as claimed in claim 4, wherein said backing support means includes a supporting face extending between and downstream of adjacent fuel nozzle support flanges up to a midportion of each of said fuel nozzle support flanges.

7. The combustor as claimed in claim 6, wherein said supporting face is located with a small clearance downstream of said adjacent fuel nozzle support flanges for allowing for the thermal expansion of said dome structure and each of said fuel cup assemblies.

8. The combustor as claimed in claim 4, wherein said backing support means includes a pair of supporting faces, each of said supporting faces extending downstream of one of said adjacent fuel nozzle support flanges up to approximately a midportion of the associated fuel nozzle support flanges.

9. The combustor as claimed in claim 8, wherein and supporting faces are located with a small clearance downstream of the associated fuel nozzle support flanges for allowing for the thermal expansion of said dome structure and said fuel cup assemblies.

10. The combustor as claimed in claim 4, wherein said backing support means includes a pair of mounting flanges fixed to said fuel cup assembly mounting means, said backing support means including an elongated arcuate body extending between said backing support mounting flanges and extending between and downstream of adjacent fuel nozzle support flanges.

11. The combustor as claimed in claim 4, wherein said wing-like supporting surfaces are located with a small clearance downstream of the associated fuel nozzle support flanges for allowing for the thermal expansion of said dome structure and said fuel cup assemblies.

12. The combustor as claimed in claim 6, wherein said backing support means includes an upstanding body portion from said backing support mounting flange having a neck portion and an upwardly widening head portion terminating in said support surface.

13. The combustor as claimed in claim 8, wherein said backing support means includes a pair of upstanding body portions from said backing support mounting flange, each of said body portions having a neck portion and an upwardly widening head portion terminating in said support surfaces.

14. The combustor as claimed in claim 10, wherein said elongated arcuate body includes a centrally located stiffening rib and wing-like supporting surfaces.

* * * * *